US006371006B1

(12) United States Patent
Goto et al.

(10) Patent No.: US 6,371,006 B1
(45) Date of Patent: Apr. 16, 2002

(54) CYLINDER CONTROL DEVICE

(75) Inventors: Tetsuya Goto, Aichi-ken; Kazuo Kobayashi; Yasuhiro Maeda, both of Nagano-ken, all of (JP)

(73) Assignees: Kabushiki Kaisha Toyoda Jidoshokki Seisakusho, Kariya (JP); Nishina Industrial Co., Ltd., Nagano-ken (JP)

( * ) Notice: Subject to any disclaimer, the term of this patent is extended or adjusted under 35 U.S.C. 154(b) by 0 days.

(21) Appl. No.: 09/621,609

(22) Filed: Jul. 21, 2000

(30) Foreign Application Priority Data

Jul. 23, 1999 (JP) ..... 11-209344
Jul. 23, 1999 (JP) ..... 11-209347

(51) Int. Cl.[7] ..... F15B 13/043
(52) U.S. Cl. ..... 91/445; 91/447
(58) Field of Search ..... 91/445, 453, 447

(56) References Cited

U.S. PATENT DOCUMENTS 4,088,151 A * 5/1978 Schurger ..... 91/447
4,102,250 A 7/1978 Schexnayder ..... 91/412
4,917,001 A * 4/1990 Yoshikawa et al. ..... 91/447
4,955,283 A 9/1990 Hidaka et al. ..... 91/447
4,955,461 A * 9/1990 Keir ..... 91/447
5,048,395 A 9/1991 Ohshima ..... 91/447
5,207,059 A * 5/1993 Schexnayder ..... 60/465
6,253,658 B1 * 7/2001 Kimura ..... 91/447

FOREIGN PATENT DOCUMENTS

DE 196 46 425 A1 5/1998
JP 01-091103 U 6/1989
JP 7-3043 1/1995

* cited by examiner

*Primary Examiner*—F. Daniel Lopez
*Assistant Examiner*—Igor Kershteyn
(74) *Attorney, Agent, or Firm*—Morgan & Finnegan, LLP

(57) ABSTRACT

A main passage communicated to a pump passage or a tank passage by switching operation of a spool valve is provided with an operation check valve permitting communication only to a cylinder. A puppet in the operation check valve is provided with an orifice communicating the main passage with a pilot chamber of the operation check valve. The pilot chamber is communicated with the main passage through an electromagnetic on/off valve. Further, the pilot chamber in the operation check valve is communicated through a bypass passage with the main passage, and the bypass passage is provided with a manually operable opening/closing valve.

7 Claims, 7 Drawing Sheets

CYLINDER CONTROL DEVICE

BACKGROUND OF THE INVENTION

1. Field of the Invention

This invention relates to a cylinder control device used in an industrial vehicle such as a forklift.

2. Description of the Related Art

A cylinder control device of this type is described, for instance, in Japanese Examined Utility Model Publication No.7-3043. The cylinder control device having downward motion preventing function as disclosed in that publication is designed to control a lift cylinder of a forklift, and provided with an operation check valve in a main passage communicating a bottom chamber of the lift cylinder with a lift cylinder operating spool valve so as to only permit communication from the spool valve side to the lift cylinder side. A pilot passage is provided with an electromagnetic on/off valve for an opening operation of the operation check valve so that the operation check valve is not opened unless the electromagnetic on/off valve is energized to be open. Further, in a state where the electromagnetic on/off valve is not energized, the lift cylinder is prevented from being moved downward even if the spool valve is erroneously operated.

The cylinder control device described in the above publication is designed so that the working oil of the lift cylinder, at the time of the downward movement of the fork, flows out through two passages, namely, the main passage for communication from the operation check valve through the spool valve to a tank, and another passage for communication from the pilot chamber of the operation check valve through the pilot passage of the operation check valve, the electromagnetic on/off valve and the spool valve to the tank.

For this reason, even if the electromagnetic on/off valve is fixed to or malfunctioned toward the "open" state, the upward and downward movements of the lift cylinder can be conducted without any abnormal feeling and similarly to the normal operation. Consequently, it is difficult for an operator to recognize an operation error of the electromagnetic on/off valve, and the electromagnetic valve may be left out of order. This gives rise to a problem in that the downward motion preventing function for the lift cylinder does not serve properly.

Further, the working oil, at the time of downward movement of the lift cylinder, flows out to the tank through two locations (two passages). This means that there are two locations or passages that must be processed with high precision. In other words, there are two locations or passages which are particularly relevant in determining a speed at the time of low-speed operation, and which must be finely adjusted to obtain proper opening degrees. Furthermore, portions of the spool valve and the valve body to be processed are also increased inevitably in number. Consequently, the manufacturing cost becomes high.

The cylinder control device constructed to have the operation check valve and the electromagnetic on/off valve as mentioned above is effective in view of enhanced safety since in an off-state of a key switch, the electromagnetic on/off valve is in a "closed" state so that the lift cylinder is prevented from being moved downwardly even if the spool valve is erroneously operated. On the other hand, this, however, requires that a condition for opening the operation check valve with energizing of the electromagnetic on/off valve (the communication of the pilot chamber of the operation check valve with the tank passage) must be met in addition to the operation of the spool valve in order to enable the downward movement of the lift cylinder.

Therefore, in a case where the electromagnetic on/off valve can not be energized because of trouble, or the electromagnetic on/off valve can not be moved due to fixation, the electromagnetic on/off valve is kept closed, so that the operation check valve is not opened even if the spool valve is operated to be at the downward movement position, and accordingly the fork can not be moved downwardly.

In view of these problems, such a cylinder control device is proposed, that enables the downward movement of the lift cylinder even in a abnormal state where the electromagnetic on/off valve is fixed or cannot be energized. The cylinder control device of this type is disclosed, for instance, in a Japanese Utility Model Application Laid-open No. 1-91103.

The cylinder control device described in the above publication has such an arrangement in that the pilot chamber of the operation check valve is connected to a bypass passage communicated with the tank passage regardless of the opening/closing of the electromagnetic on/off valve, and a manually operable opening/closing valve is provided to the bypass passage.

Although the cylinder control device as mentioned above makes it possible to move the lift cylinder downwardly by operatively opening the opening/closing valve in the case of the abnormal state where the electromagnetic on/off valve is fixedly kept closed or can not be energized, the operation for the downward movement of the lift cylinder may cause a danger since the lift cylinder starts its downward movement immediately after the opening/closing valve is opened and it is difficult to adjust the speed of the downward movement.

SUMMARY OF THE INVENTION

The present invention has been made in view of the problems mentioned above. An object of the present invention is to provide a cylinder control device that can allow an operator to recognize an abnormality of an electromagnetic on/off valve and that can be manufactured with reduced cost.

Another object of the present invention is to provide a cylinder control device that enables a downward movement of a lift cylinder in an abnormal state where the electromagnetic on/off valve is fixedly kept closed or cannot be energized as safely as in the normal state.

A cylinder control device according to the present invention includes a main passage one end of which is communicated through a port with a cylinder, a spool valve for communicating another end of the main passage with a pump or a tank by switching operation, an operation check valve disposed on the main passage for permitting only the communication from the spool valve to the cylinder, the operation check valve having a pilot chamber communicated through a first orifice with a cylinder side of the main passage, a pilot passage one end of which is communicated with the pilot chamber and another end of which is communicated with a spool valve side of the main passage, and an electromagnetic valve for opening and closing the pilot passage.

DETAILED DESCRIPTION OF THE PREFERRED EMBODIMENTS

Embodiment 1

Hereafter, a first embodiment of the present invention will be described with reference to FIGS. 1 to 3.

Figure 1:
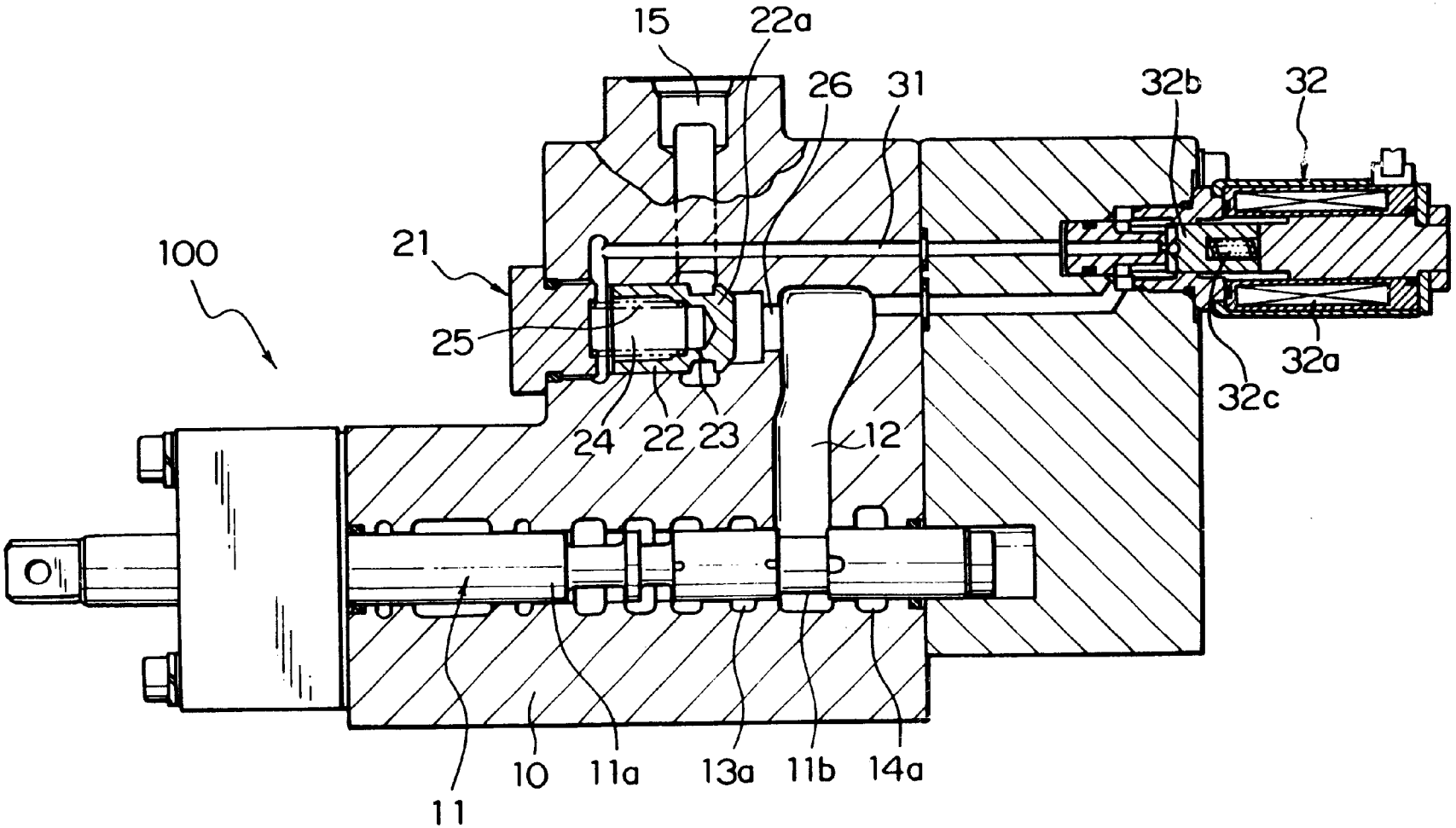
FIG. 1 is a cross-sectional view showing a cylinder control device according to a first embodiment.

A cylinder control device 100 according to this embodiment is adapted to a battery type forklift, and is provided with a manually operable type lift spool valve 11 for operating a lift cylinder 3 to move a fork 2 upwardly and downwardly along a mast 1 as shown in FIG. 1.

Figure 2:
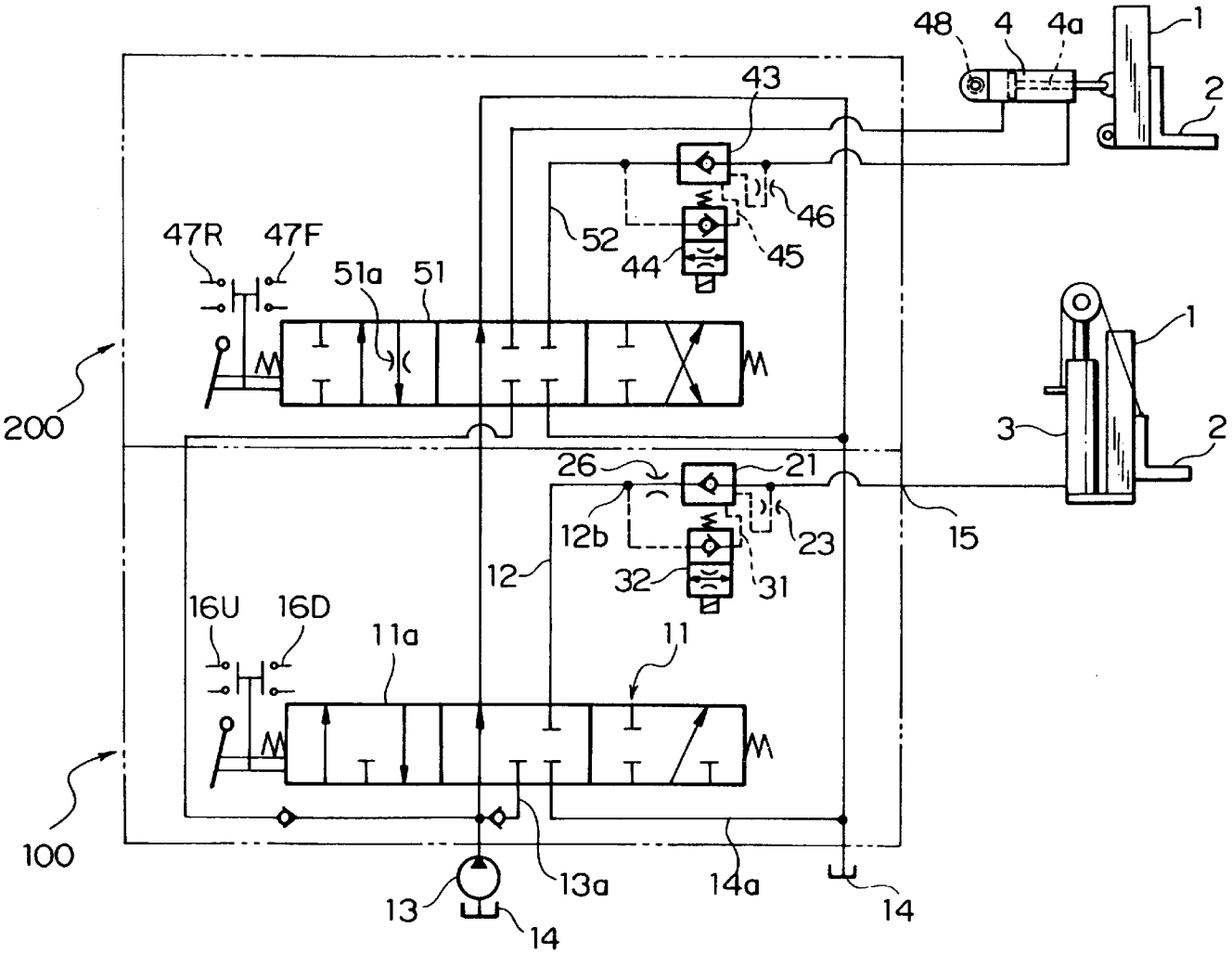
FIG. 2 is a hydraulic circuit diagram of a lift cylinder for fork upward and downward movements and a tilt cylinder for mast tilting, using the cylinder control device according to the first embodiment.

The cylinder control device 100 is constructed as shown in FIG. 2.

A valve body 10 is provided with a main passage 12 for communicating the spool valve 11 and the lift cylinder 3 together. This main passage 12 is communicated at its one end with a cylinder port 15 and at its the other end with a pump passage 13*a* to be communicated with a pump 13 (see FIG. 1) or a tank passage 14*a* communicated with a tank 14 (see FIG. 1) upon operation of a spool 11*a* slidingly-operatively assembled to the valve body 10.

An operation check valve 21 is provided at the cylinder port 15 side of the main passage 12 to permit the flow of working oil only from the spool valve 11 side to the cylinder 3 side. As shown in FIG. 3, the operation check valve 21 has a puppet 22, an orifice 23 formed in the puppet 22 (hereafter, the orifice is referred to as a first orifice), a pilot chamber 24 communicated through the orifice 23 to the main passage 12, and a spring 25 depressing the puppet 22 onto a seat 12*a* of the main passage 12.

Accordingly, a pressure within a bottom chamber of the lift cylinder 3 is constantly applied to the pilot chamber 24 through the first orifice 23, and the puppet 22 is depressed onto the seat 12*a* by the pilot pressure and the spring force so that the operation check valve is kept in a closed state.

As shown in FIGS. 1 and 2, the valve body 10 is formed with a pilot passage 31. The pilot passage 31 is provided with an electromagnetic on/off valve (hereafter, simply referred to as an electromagnetic valve) 32 for opening operation of the operation check valve 21 at the time of downward movement of the lift cylinder 3. One end of the pilot passage 31 is communicated with a pilot chamber 24 of the operation check valve 21, and the other end thereof is communicated with a part of the main passage 12 which is located between the spool valve 11 and the operation check valve 21.

The electromagnetic valve 32 is designed to be open such that a ball valve 32*b* is moved apart from the seat when a solenoid 32*a* is energized, and closed such that the ball valve 32*b* is depressed onto the seat by a spring 32*c* when the solenoid is non-energized. Further, it is set such that it is energized only when a key switch is in an on-state and the spool valve 11 is operated to be in the downward movement position, and it is not energized in other conditions including an off-state of the key switch.

The main passage 12 is formed with another orifice 26 (hereafter, referred to as a second orifice) that is located between a communicated part 12*b* to the pilot passage 31 and the operation check valve 21 and that is larger in passage area than the first orifice 23.

In this embodiment adapted or directed to the battery type forklift, a motor (not shown in the drawings) for driving the pump 13 is activated based on a detection signal of spool position detecting limit switches 16U and 16D that detect operation of the spool 11*a* from the illustrated neutral position to the upward movement position or the downward movement position.

Therefore, if the spool 11*a* is operated to be in the upward movement position so that the main passage 12 is communicated with the pump passage 13*a*, the pressure of the working oil supplied from the hydraulic pump 13 acts on a corn portion 22*a* of the puppet 22. At this time, since the electromagnetic valve 32 is closed, the pressure causes the working oil within the pilot chamber 24 to flow out from the first orifice 23 through the main passage 12 to the bottom chamber of the lift cylinder 3 to open the puppet 22. After the opening, the presence of the first orifice 23 prevents the pressure within the pilot chamber 24 from reaching the pump pressure and keeps the opening state of the puppet 22. Accordingly, the fork 2 is moved upward together with the lift cylinder 3.

If the spool 11*a* is returned to the neutral position after the upward movement, the operation check valve 21 is closed so as to hold the fork 2 at the upwardly moved position.

If the spool 11*a* is operated to be in the downward movement position, the main passage 12 is communicated with the tank passage 14*a*. At this time, since the electromagnetic valve 32 is energized to be opened, the pilot passage 31 is communicated with the main passage 12. Therefore, the working oil within the lift cylinder 3 flows out from the first orifice 23 through the pilot chamber 24, the pilot passage 31 and the electromagnetic valve 32 to the main passage 12. Concurrently, a pressure difference is generated between the upstream side and the downstream side of the first orifice 23. That is, the pressure in the main passage 12 side becomes higher than that in the pilot chamber 24.

Figure 3:
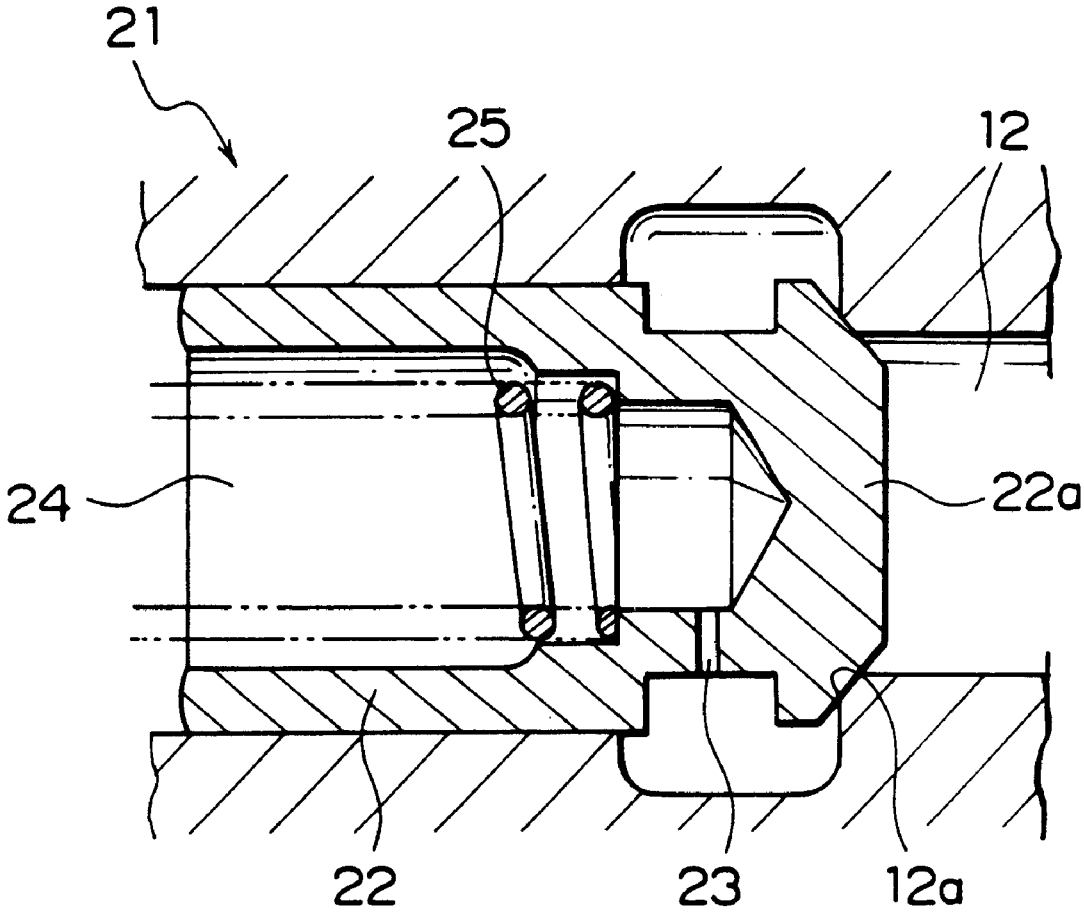
FIG. 3 is a cross-sectional view showing a puppet portion of an operation check valve in the first embodiment.

For this reason, as shown in FIG. 3, the puppet 22 is depressed and opened against the spring 25 by the pressure acting on a surface of the corn portion 22*a* which faces the main passage 12. Consequently, the puppet 22 is opened, and the working oil within the lift cylinder 3 flows out to the tank 14 so that the fork 2 is moved downwardly together with the lift cylinder 3.

On the other hand, in the off-state of the key switch, the electromagnetic valve 32 is kept in the closed state. Accordingly, in this state, even if the spool la is operated to be in the downward movement position, the pressure within the pilot chamber 24 of the operation check valve 21 is not lowered, and the operation check valve 21 is kept in the closed state. That is, unless the electromagnetic valve 32 is opened, the downward movement preventing function serves properly, and thus the fork 2 can be surely prevented from being moved downward even if the spool 11 is operated erroneously in any fashion.

During the downward movement mentioned above, a part of the working oil flowing out from the lift cylinder 3 passes through the pilot passage 31 while the remains passes through the main passage 12 and then mixed together at the upstream side of the spool valve 11. That is, in the present embodiment, since the pilot passage 31 is communicated at its one end with the pilot chamber 24 of the operation check valve 21 and at its the other end with the communicated part 12*b* of the main passage 12, during the downward movement of the lift cylinder 3, the passage area through which the working oil flow out to the tank 14 is determined by only one passage location in the spool 11*a*, i.e. an annular groove 11*b*.

For this reason, similarly to a device that does not have the downward movement preventing function, there is only one location that must be processed with high precision, and in other words, there is only one location which is relevant in determining a speed at the time of low-speed operation, and which must be finely adjusted to obtain a proper opening degree. Further, in comparison to the conventional device having the downward movement preventing function, the portions of the valve body 10 and the spool 11*a* to be processed for passage formation can be decreased in number. Therefore, the manufacturing cost can be decreased.

In a case where the electromagnetic valve 32 is fixed at (or malfunctioned to) the open state because of some reasons, the working oil supplied through the spool valve 11 when the lift cylinder 3 is operated to be moved upward passes through the pilot passage 31 and acts on the pilot chamber 24 of the operation check valve 21, and accordingly the puppet 22 is not opened. For this reason, the lift cylinder 3 is moved upward at a low speed only with the small flow rate working oil sent from the pilot chamber 24 through the first orifice 23 to the lift cylinder 3, and therefore the operator can recognize the abnormality. The same is applied to the case where the downward movement is followed by the reupward movement.

Therefore, by setting the upward movement speed at this time so low as to hinder the normal work, the necessity of maintenance of the electromagnetic valve 32 can be notified, and consequently the downward movement preventing function can be maintained and thus the safety can be ensured.

According the present embodiment, the second orifice 26 is provided at a part of the main passage 12 between the operation check valve 21 and the communicated part 12*b* to the pilot passage 31. Therefore, if the puppet 22 of the operation check valve 21 begins to be opened when the lift cylinder is moved downwardly, the hydraulic pressure Pp of the pilot chamber 24 and the hydraulic pressure Po acting on the corn portion 22*a* of the puppet 22 through the second orifice 26 are differentiated from each other. Then, as the downward movement speed of the lift cylinder 3 is increased, the difference between these hydraulic pressures becomes larger (Pp>Po) to enhance the operation responsibility of the operation check valve 21. Accordingly, it is possible to smoothly change the downward movement speed.

When the spool valve 12 is operated to be in the downward movement position, the motor for the pump 13 is driven. This is for the purpose of enabling the simultaneous operation of a tilting spool valve 51 (for operating a tilting cylinder 4 to tilt the mast 1) installed on the downstream side of the lifting spool valve 11 as shown in FIG. 2. That is, when the spool 11a of the spool valve is located at the neutral position or the downward movement position, the pump passage 13*a* is communicated with the tilting spool valve 51.

In the present embodiment, for a rod side oil chamber 4*a* of the tilting cylinder 4 for tilting the mast 1, a cylinder control device 200 having a forward tilting movement preventing function that is equivalent in function to the downward movement preventing function of the lift cylinder 3 as mentioned above is provided.

That is, as shown in a hydraulic circuit diagram of FIG. 2, an operation check valve 43 is provided to a rod side main passage 52 communicating the tilting spool valve 51 with the rod side oil chamber 4*a* of the tilting cylinder 4 so as to only permit the communication from the spool valve 51 side to the cylinder 4 side. Further, the pilot passage 45 communicated with a pilot chamber of the operation check valve 43 is provided with an electromagnetic valve 44 for opening operation of the operation check valve 43, and the pilot passage 45 is communicated with the rod side main passage 52.

Note that an orifice 46 corresponding to the first orifice 23 of the lifting control system is provided, but an orifice corresponding to the second orifice 26 is not provided. This is because the forward tilting speed when the mast is operatively tilted forwardly can be controlled in nature by a throttle valve 51*a* provided in the working oil flowing-out passage of the spool valve 51.

Therefore, if the control system for the tilting cylinder 4 adopts the above-mentioned arrangement, by the joint use of spool operation position detecting switches 47F and 47R and a tilting angle sensor 48, in a case where the mast is tilted forwardly, the electromagnetic valve 44 is non-energized at a time point at which the fork 2 reaches a horizontal position, to close the operation check valve 43. This enables a horizontal alignment in which the fork 2 is pushed horizontally. In a case where the mast is tilted rearwardly, the electromagnetic valve 44 is energized at a time point at which the fork 2 reaches the horizontal position, to close the operation check valve 43 (in this case, as explained with reference to the lifting control system, a small quantity of working oil restricted by the orifice 46 is supplied to the rod side oil chamber 4*a* and thus the deceleration is realized), thereby enabling the horizontal alignment.

In a case where a mast elevation sensor and a load sensor (both being unillustrated in the drawings) are used jointly in addition to the above-mentioned spool operation position detecting switches 47F and 47R and tilting angle sensor 48, a so-called forward tilting angle restriction can be realized in such a manner that, when the mast that is high in elevated position and that is large in load is tilted forwardly, the electromagnetic valve 44 is non-energized if the mast 1 is tilted to have a proper angle, to close the operation check valve 43, thereby stopping the forward tilting movement of the mast 1.

As described above, according to the cylinder control device 100, it is possible, in a cylinder control device having a function of preventing a cylinder movement upon erroneous operation, to recognize an abnormality of an electromagnetic on/off valve as well as to reduce the manufacturing cost.

Embodiment 2

Figure 4:
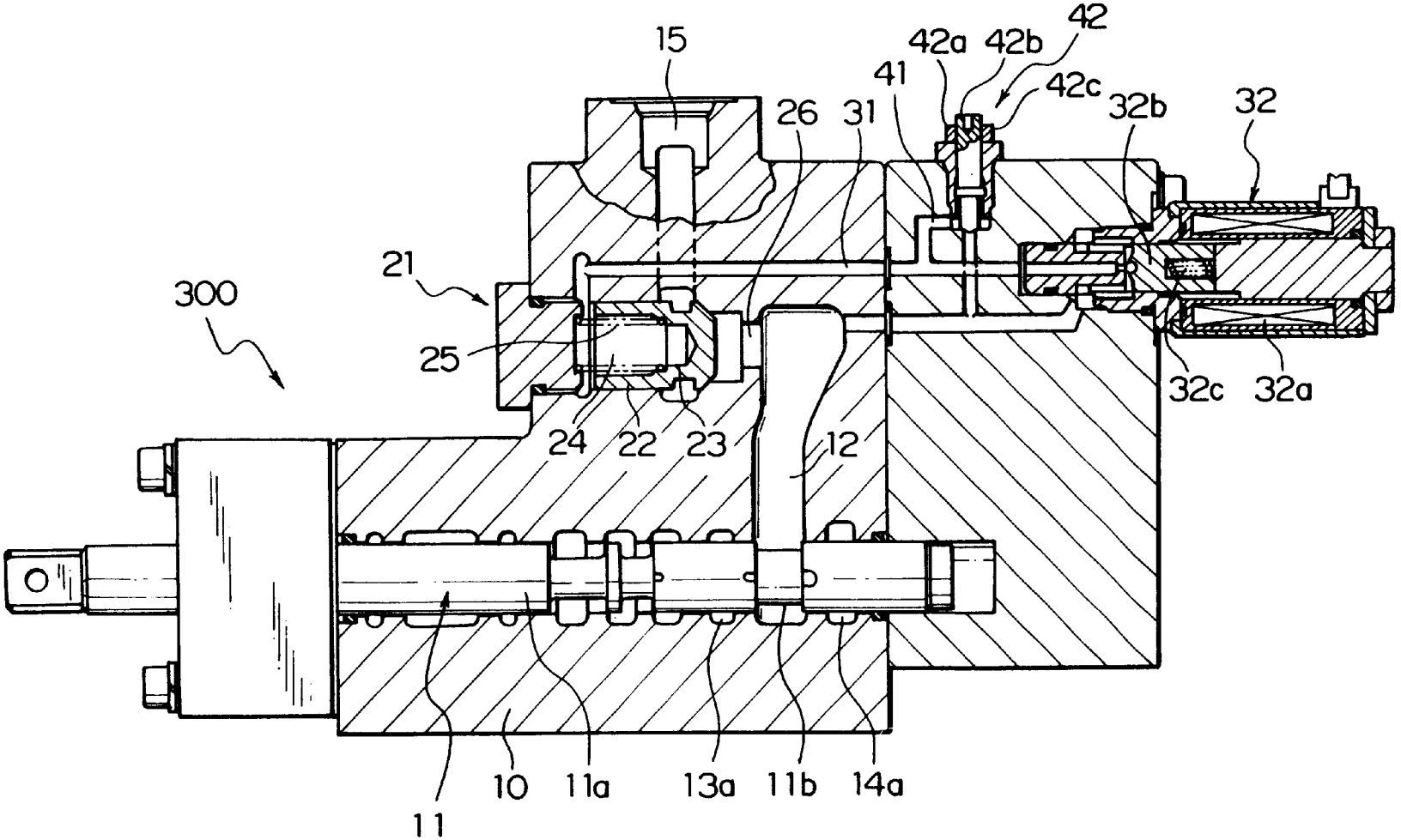
FIG. 4 is a cross-sectional view showing a cylinder control device according to a second embodiment.
Figure 5:
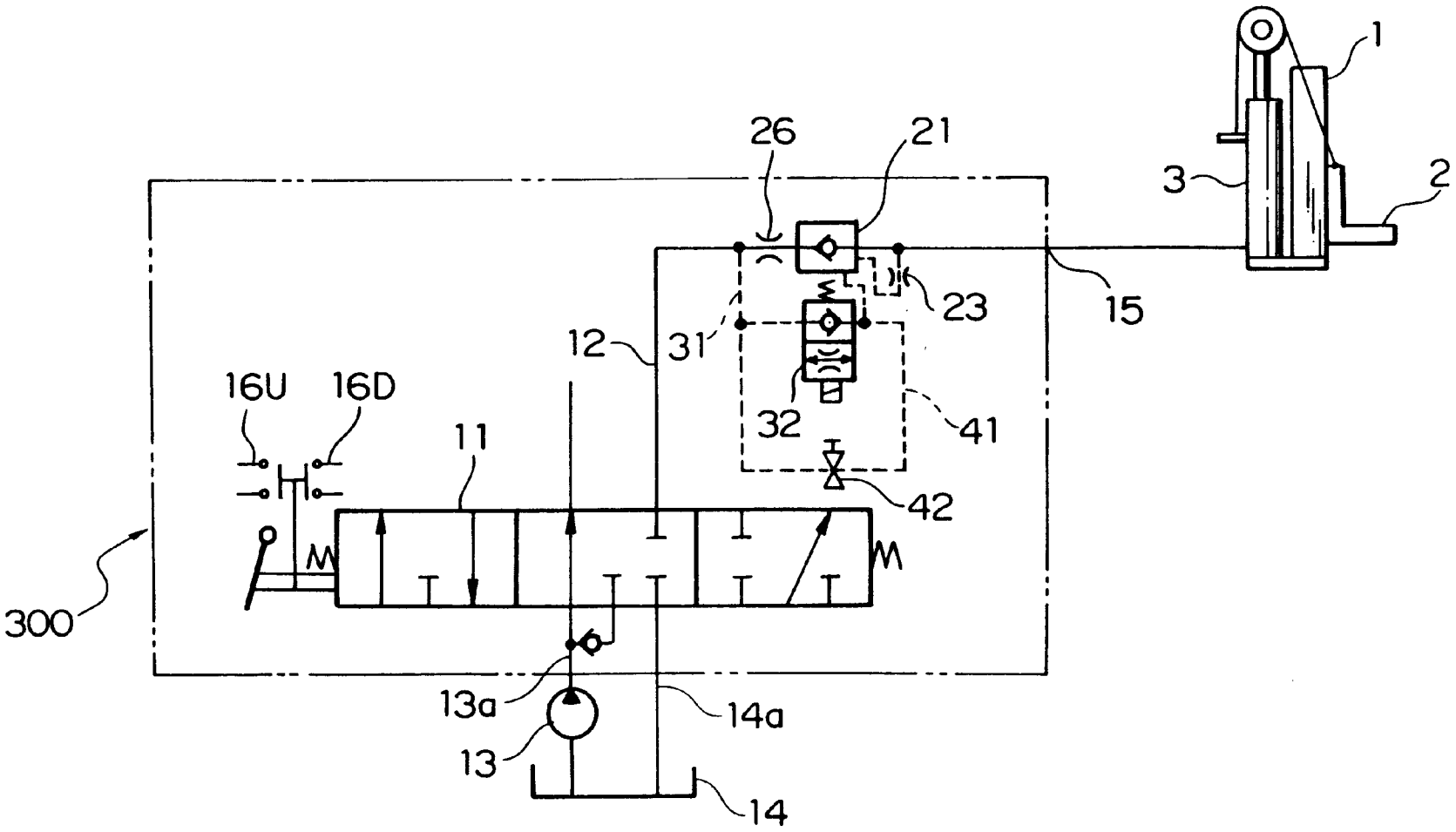
FIG. 5 is a hydraulic circuit diagram of a lift cylinder for fork upward and downward movements, using the cylinder control device according to the second embodiment.

FIG. 4 is a cross-sectional view showing an arrangement of a cylinder control device 300 according to a second embodiment of the present invention. The cylinder control device 300 is arranged such that a bypass passage 41 is added, and an opening/closing valve 42 is provided in midway thereof, in the device of the first embodiment shown in FIG. 1. In FIG. 5, a hydraulic circuit for a fork upward movement/downward movement lifting cylinder using the cylinder control device 300 according to the second embodiment of the present invention is only shown, and a hydraulic circuit for a mast tilting movement tilting cylinder is omitted from the illustration.

In FIGS. 4 and 5, elements or portions the same as or equivalent to the elements or portions in FIGS. 1 to 3 are denoted by the same reference numerals, and accordingly repeated description thereof is omitted.

The valve body 10 is formed with a bypass passage 41 that is for the emergency downward movement of the lift cylinder 3 and that is in parallel to the pilot passage 31. That is, the bypass passage 41 communicates the pilot chamber 24 of the operation check valve 21 with a part of the main passage 12 between the spool valve 11 and the operation check valve 21.

The bypass passage 41 is provided with a manually operable opening/closing valve 42 that keeps the bypass passage 41 in a closed state normally. This opening/closing valve 42 includes a main body 42*a*, a puppet type threaded valve body 42*b* threaded into the main body 42*a*, and a loosening preventing lock nut 42*c*. The valve 42 is opened or closed by rotating the valve body 42*b* with a wrench fitted to a hexagonal hole in the head of the valve body 42*b*.

In the second embodiment, the bypass passage 41 is provided to the pilot passage 31, so in the case of abnormal or emergency state in which the electromagnetic valve 32 is fixed at the closed state or can not be energized, the opening operation of the manually operable opening/closing valve 42 can cause the pilot chamber 24 of the operation check valve 21 to be communicated through the bypass passage 41 with the main passage 12. That is, the state the same as the state in which the electromagnetic valve 32 is opened can be established.

For this reason, after the opening/closing valve 42 is opened, the operation of the spool valve 11 makes it possible to downwardly move the lift cylinder 3 with safety similarly to the normal state, while freely adjusting the downward movement speed thereof.

In the state in which the opening/closing valve 42 is opened, if the upward movement operation is erroneously conducted after the lift cylinder 3 is moved downward with the operation of the spool 11, the working oil supplied through the spool valve 11 is sent through the bypass passage 41 to the pilot chamber 24, and therefore the operation check valve 21 can not be opened. For this reason, similarly to the aforementioned case where the electromagnetic valve 32 is fixed at the open state, the lift cylinder 3 is supplied with a small flow rate working oil passed through the first orifice 23, and accordingly, the upward movement of the lift cylinder 3 is conducted at a low speed, and the safety is not sacrificed largely.

Figure 6:
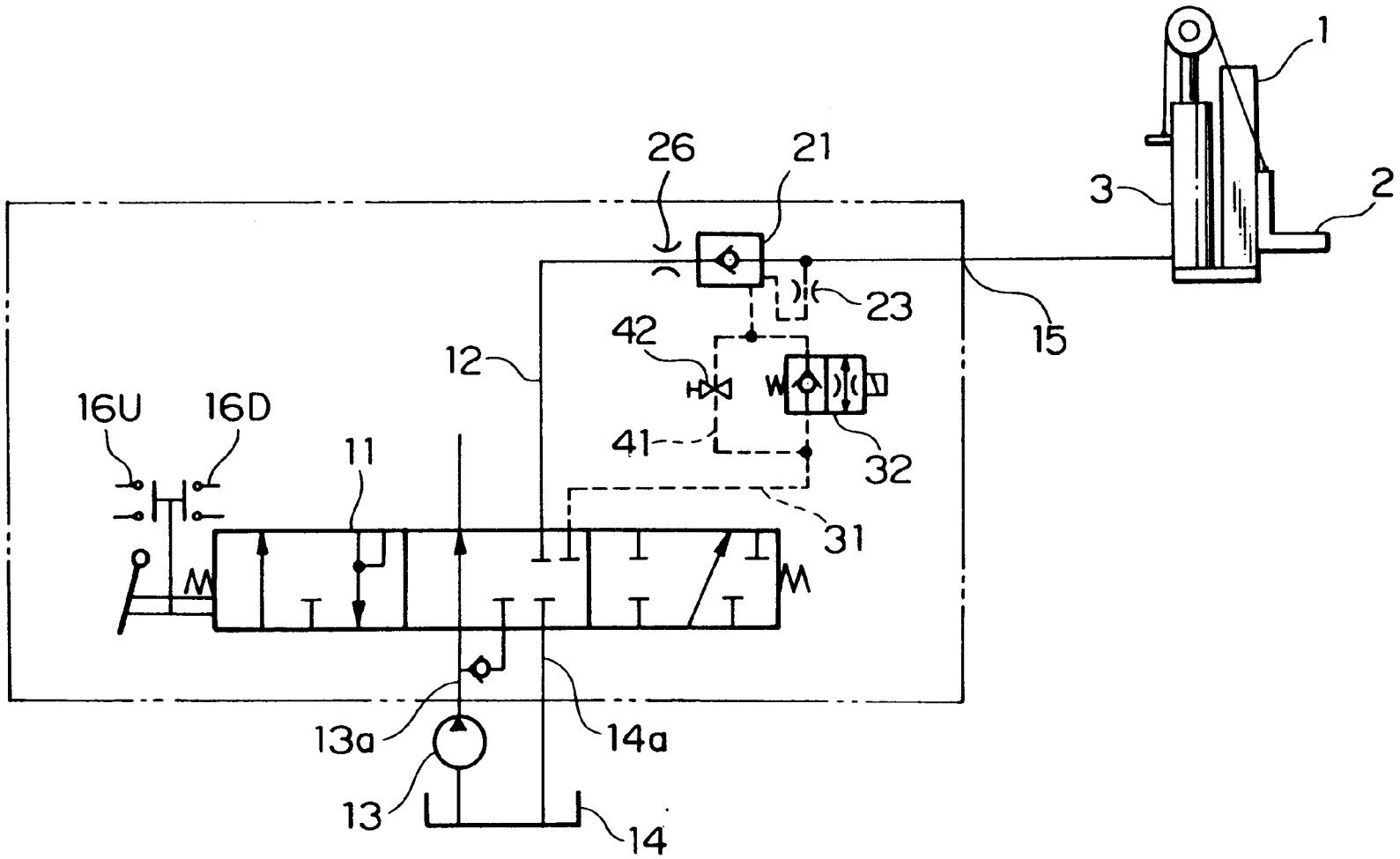
FIGS. 6 and 7 respectively show hydraulic circuit diagrams of a lift cylinder for fork upward and downward movements, using modifications of the cylinder control device according to the second embodiment.
Figure 7:
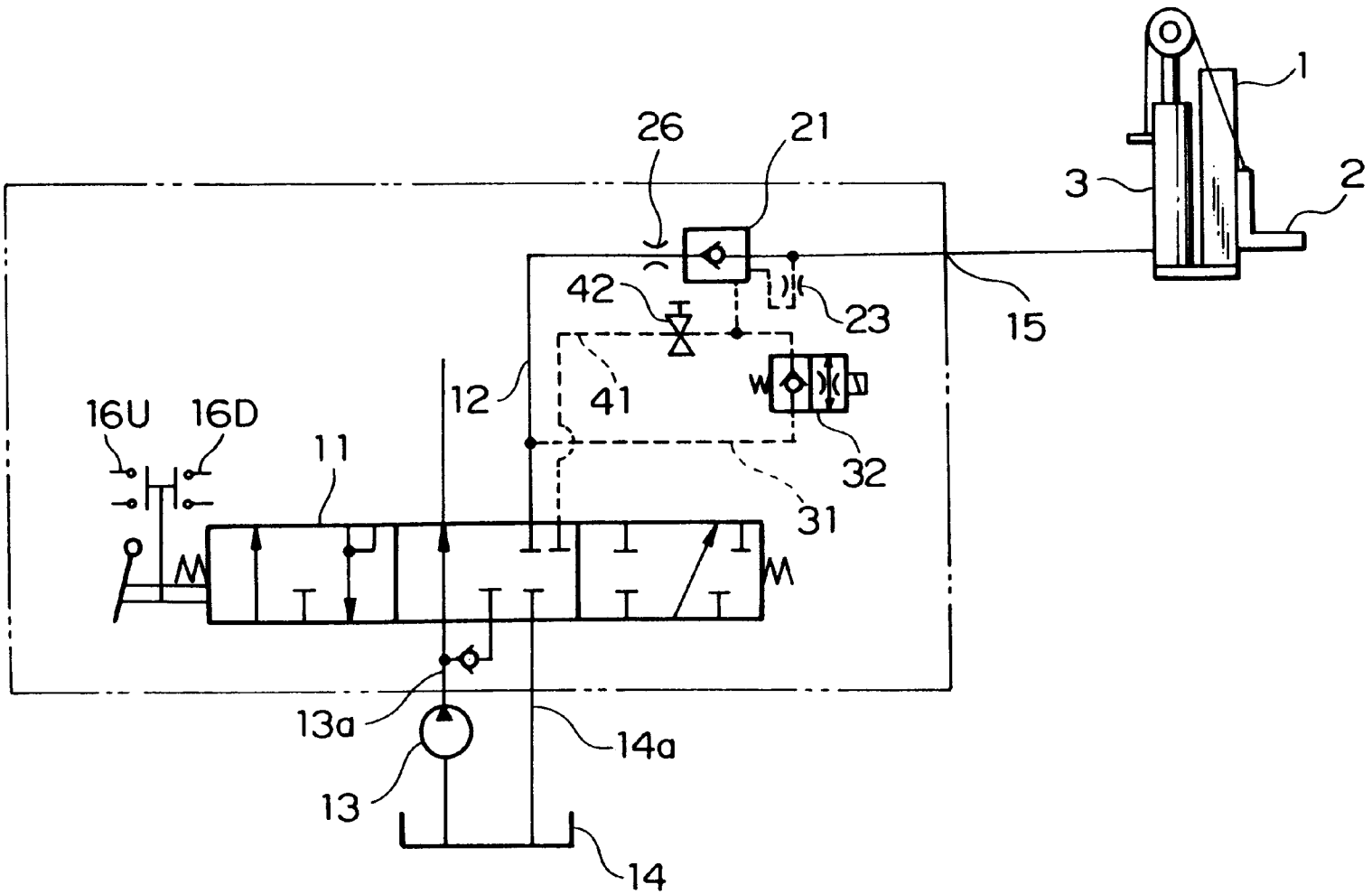

In the second embodiment described above, the pilot passage 31 and the bypass passage 41 are arranged to be communicated with the main passage 12. However, the invention should not be limited to this arrangement. For example, as shown in a hydraulic circuit diagram of FIG. 6, the pilot passage 31 and the bypass passage 41 may be modified to be communicated with the tank passage 14*a* through the spool valve 11 independently of the main passage 12. Further, as shown in FIG. 7, only the bypass passage 41 may be communicated through the spool valve 11 with the tank passage 14*a*.

Furthermore, the opening/closing valve 42 should not be limited, in arrangement and operation manner, to that described with reference to the embodiment.

As described above, according to the cylinder control device 300, it is possible, in a cylinder control device having a function of preventing a cylinder movement upon erroneous operation, to safely move a lift cylinder downwardly, similarly to the normal state, even in a abnormal state in which an electromagnetic on/off valve is fixed at the closed state or is failed to be energized, in addition to the effects of the cylinder control device 100 of the first embodiment.

The cylinder control devices according to the first and second embodiments as mentioned above are described with reference to a case of a battery type forklift, i.e., a case where the pump 13 is driven by the motor, however, the present invention can, of course, be applied to an engine vehicle in which the pump 13 is driven by an engine.

The present invention can be applied not only to the lift cylinder 3 of a forklift but also to a lift cylinder of other industrial vehicles such as a power shovel and a high-site working vehicle.

What is claimed is:

1. A cylinder control device comprising:

a main passage one end of which is communicated through a port with a cylinder;

a spool valve for communicating another end of the main passage with a pump or a tank by switching operation;

an operation check valve disposed on the main passage for permitting only the communication from the spool valve to the cylinder, the operation check valve having a pilot chamber communicated through a first orifice with a cylinder side of the main passage, the first orifice having a constant area;

a pilot passage one end of which is communicated with the pilot chamber and another end of which is communicated with a spool valve side of the main passage; and an electromagnetic valve for open and closing the pilot passage.

2. The cylinder control device according to claim 1, wherein the pilot passage is communicated with the main passage at a communicated part between the operation check valve and the spool valve.

3. The cylinder control device according to claim 2, further comprising:

a second orifice provided on the main passage and having one end communicated with the operation check valve and another end communicated with the communicated part, the second orifice being larger in passage area than the first orifice.

4. The cylinder control device according to claim 1, further comprising:

a bypass passage formed in parallel to the pilot passage for communicating a pilot chamber of the operation check valve with a spool valve side of the main passage; and an opening/closing valve disposed on the bypass passage for opening/closing the bypass passage independently of operation states of the electromagnetic valve.

5. The cylinder control device according to claim 4, wherein the bypass passage is communicated with the main passage at a location between the operation check valve and the spool valve.

6. A cylinder control device comprising:

a main passage one end of which is communicated through a port with a cylinder;

a spool valve for communicating another end of the main passage with a pump or a tank by switching operation;

an operation check valve disposed on the main passage for permitting only the communication from the spool valve to the cylinder, the operation check valve having a pilot chamber communicated through a first orifice with a cylinder side of the main passage;

a second orifice provided on the main passage and having one end communicated with the operation check valve and another end communicated with the communicated part, the second orifice being larger in passage area than the first orifice;

a pilot passage one end of which is communicated with the pilot chamber and another end of which is communicated with a spool valve side of the main passage; and an electromagnetic valve for opening and closing the pilot passage.

7. A cylinder control device comprising:

a main passage one end of which is communicated through a port with a cylinder;

a spool valve for communicating another end of the main passage with a pump or a tank by switching operation;

an operation check valve disposed on the main passage for permitting only the communication from the spool valve to the cylinder, the operation check valve having a pilot chamber communicated through a first orifice with a cylinder side of the main passage;

a pilot passage one end of which is communicated with the pilot chamber and another end of which is communicated with a spool valve side of the main passage;

an electromagnetic valve for opening and closing the pilot passage;

a bypass passage formed in parallel to the pilot passage for communicating a pilot chamber of the operation check valve with a spool valve side of the main passage; and an opening/closing valve disposed on the bypass passage for opening/ closing the bypass passage independently of operation states of the electromagnetic valve.

* * * * *

UNITED STATES PATENT AND TRADEMARK OFFICE

CERTIFICATE OF CORRECTION

PATENT NO. : 6,371,006 B1
DATED : April 16, 2002
INVENTOR(S) : Tetsuya Goto et al.

It is certified that error appears in the above-identified patent and that said Letters Patent is hereby corrected as shown below:

Column 8,
Line 28, please delete “open” and insert therefor -- opening --

Signed and Sealed this

Twenty-fifth Day of June, 2002

*Attest:*

*Attesting Officer*

JAMES E. ROGAN
*Director of the United States Patent and Trademark Office*